US005685123A

United States Patent [19]

Alderman et al.

[11] Patent Number: 5,685,123

[45] Date of Patent: Nov. 11, 1997

[54] ROLLER GUIDES FOR APPARATUS FOR PAYING OUT AN INSULATION SUPPORT SHEET

[75] Inventors: Robert J. Alderman, Canyon Lake; James E. Taylor, Seguin, both of Tex.; Dennis K. Wenrick, Oviedo, Fla.

[73] Assignee: Owens-Corning Fiberglas Technology, Inc., Summit, Ill.

[21] Appl. No.: 536,557

[22] Filed: Sep. 29, 1995

[51] Int. Cl.[6] ..... E04G 21/14

[52] U.S. Cl. ..... 52/749.12; 52/746.11; 52/404.1; 52/478; 242/557; 242/598.5; 242/610.3

[58] Field of Search ..... 52/749.12, 746.11, 52/404.1, 478; 242/557, 598.5, 610.3, 598

[56] References Cited

U.S. PATENT DOCUMENTS

| | | | |
|---|---|---|---|
| 3,559,914 | 2/1971 | Alderman . | |
| 3,969,863 | 7/1976 | Alderman . | |
| 4,047,345 | 9/1977 | Alderman . | |
| 4,047,346 | 9/1977 | Alderman . | |
| 4,068,446 | 1/1978 | Brueske . | |
| 4,075,807 | 2/1978 | Alderman . | |
| 4,078,355 | 3/1978 | Clemensen | 52/749.12 X |
| 4,147,003 | 4/1979 | Alderman . | |
| 4,222,212 | 9/1980 | Alderman | 52/749.12 |
| 4,860,518 | 8/1989 | Kingham | 52/749.12 X |
| 4,864,837 | 9/1989 | Fielden, Jr. | 52/749.12 X |
| 4,967,535 | 11/1990 | Alderman | 52/749.12 |
| 4,993,207 | 2/1991 | Burke | 52/749.12 |
| 5,081,815 | 1/1992 | Carnell | 52/749.12 |
| 5,381,597 | 1/1995 | Petrove | 52/749.12 X |
| 5,491,952 | 2/1996 | Alderman et al. | 52/749.12 |
| 5,551,203 | 9/1996 | Alderman | 52/749.12 X |

OTHER PUBLICATIONS

Declaration of Robert J. Alderman.

*Primary Examiner*—Wynn E. Wood

*Attorney, Agent, or Firm*—C. Michael Gegenheimer; Curtis B. Brueske

[57] ABSTRACT

An apparatus for providing a roof structure of the type having a plurality of purlins spaced apart from one another in a parallel arrangement is disclosed. The space between the vertical portions of adjacent purlins defines an insulation cavity that is generally rectangular in cross-sectional shape. The apparatus includes a carriage movable in a first direction along the length of the purlins for paying out a support sheet for support of insulation material as the carriage travels along the length of the purlins. The apparatus also includes at least one roller guide extending downward on top of the support sheet, rotating along the length of the support sheet, causing the support sheet to substantially conform to the shape of the insulation cavity. The roller guide is attached to the carriage and has two ends having wheels positioned at the sides of the insulation cavity.

20 Claims, 2 Drawing Sheets

ROLLER GUIDES FOR APPARATUS FOR PAYING OUT AN INSULATION SUPPORT SHEET

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. Hard roofing material such as metal decking is then attached on top of the purlins over the insulation material. Because the hard roofing material comes in long sheets and the roofs generally have two sloped sections, it is customary to construct the roof along the width of the sloped section and then proceed along the length of the structure from one end to the other. The workers stand on the previously laid section of roof to construct the next section.

The insulation material must be supported between the purlins beneath the hard roofing material. Various methods of supporting the insulation material have been used. Mounting straps or wire mesh that are attached to the purlins by forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is required. Since the lattice encompasses the entire roof, installation is costly and time consming. Once the hard roofing material is mounted on the purlins, the sheet can support the insulation material and the lattice no longer serves any useful purpose.

Some systems dispense with the lattice and use the sheet itself to support the insulation material. The support sheet is draped from the adjacent purlins and the insulation material is placed on top of the support sheet. A carriage has been used to aid in the dispensing of the support sheet. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins the support sheet is draped across the purlins. However, the support sheet sags between the purlins and results in a small vertical height at the sides of the insulation cavity adjacent to the purlins, and results in a compression of the insulation material in that area.

An additional step to compensate for the small vertical height when draping the insulation material is to use clips to hold the support sheet onto the purlin to reduce sagging. Clips that are attached to the bottom of the purlins require installation from undemeath the roof structure which requires scaffolding or lifting equipment. Clips that are installed over the purlins and extend the support sheet downward are known in the art but require the workers to lean over the edge of the previously laid section of roof and attach the clip to the purlin. Because of the increased costs due to the expense of the installation and the clips themselves, the use of clips is undesirable.

Guides have been used to prevent the sagging of the support sheet and to increase the vertical height at the sides of the insulation cavity adjacent to the purlins. The guides are mounted on the carriage and extend downward on top of the support sheet. The guides are positioned near the purlins so that the support sheet sides are extended downward. This causes the support sheet to create a generally rectangular cross-sectional area into which the insulation material can be placed. The guides, however, can tear up the support sheet as the carriage moves along the lengths of the purlins.

It would be desirable to have a system of building a roof structure that is inexpensive and simple to construct that does not require the use of lattice straps or clips, and yet provides for an insulation support system which enables the full thickness of the insulation blanket to be used.

DISCLOSURE OF INVENTION

There has now been invented an improved apparatus for providing a roof structure, which dispenses a support sheet for supporting insulation material between purlin roof beams. This apparatus provides for an inexpensive and simple system to construct a roof structure which enables the full thickness of the insulation material to be used.

The present invention comprises an apparatus for use on a roof structure of the type having a plurality of purlins spaced apart from one another in a parallel arrangement. The apparatus includes a carriage movable along a direction along the length of the purlins, with the carriage paying out a support sheet for supporting insulation material as the carriage moves along the length of the purlins. The apparatus also includes at least one roller guide movable in the same direction as the carriage moves. The roller guide extends downward on top of the support sheet. The roller guide rotates along the length of the support sheet, causing the support sheet to substantially conform to the shape of the insulation cavity. The roller guide can be attached to the carriage. The roller guide may also be adjustable to accommodate purlins having vertical portions of different heights.

In a specific embodiment of the invention, the roller guide has a single roller that spans a substantial portion of the width of the insulation cavity. The roller rotates along the length of the dispensed support sheet, thereby causing the support sheet to substantially conform to the shape of the insulation cavity.

In another specific embodiment of the invention, the roller guide has two wheels positioned at the sides of the insulation cavity, thereby causing the support sheet to substantially conform to the shape of the insulation cavity.

In yet another specific embodiment of the invention, the carriage is provided with a tension controller to maintain the support sheet in tension in a direction along the length of the purlins. A clutch may be used as the tension controller.

BEST MODE FOR CARRYING OUT THE INVENTION

Figure 1:
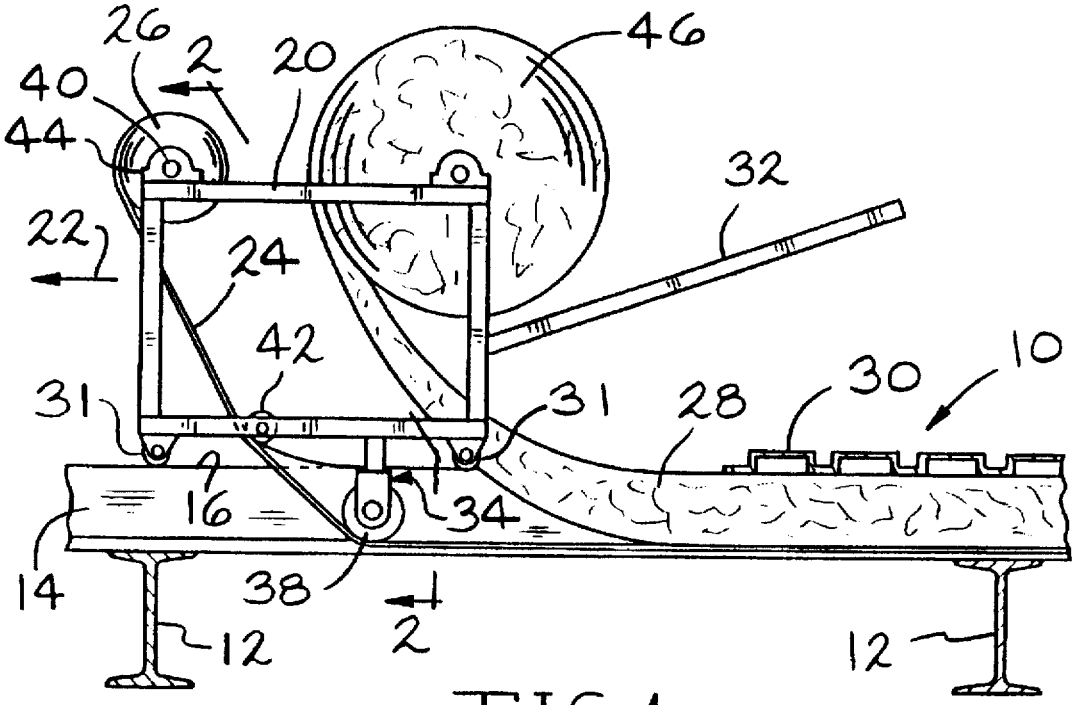
FIG. 1 is a side elevational view showing the apparatus for providing a roof structure using the present invention.
Figure 2:
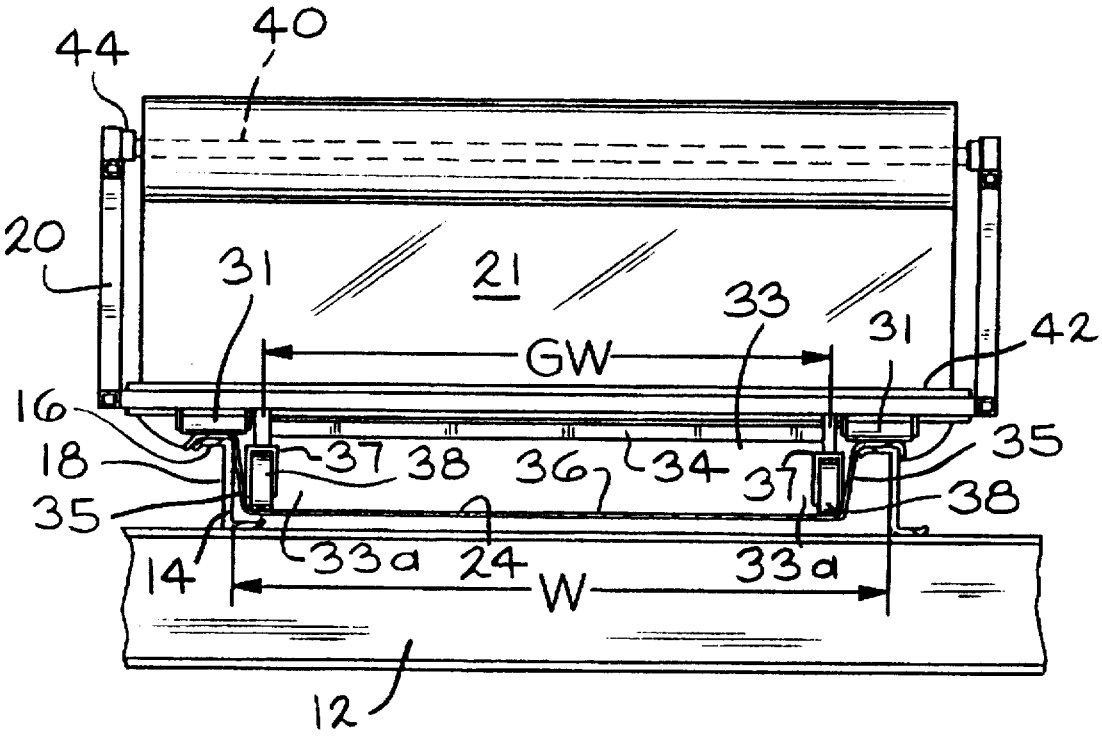
FIG. 2 is a sectional view taken along lines 2—2 of FIG. 1.

There is illustrated in FIG. 1 a building roof structure generally indicated at 10. The roof structure is typically supported by main rafter beams 12 which are positioned parallel to each other. A plurality of purlins 14, spaced apart and arranged parallel to each other, are fastened on top of the rafters in a direction normal to the rafters. The spacing of the purlins is typically 5 feet on centers. As shown in FIG. 2, the purlins have a generally Z-shaped cross-section and include a top portion 16 and a vertical portion 18. Roof structures may also be constructed from bar joists or trusses, and the invention as described herein will work equally well with purlins, bar joists or trusses. The use of the term "purlins" in this specification and claims includes not only traditional purlins, but also bar joists and trusses and other similar structural members.

As shown in FIGS. 1 and 2, a carriage 20 rides on top of the purlins and travels in a first direction 22 along the length of the purlins. As the carriage is moved, a support sheet 24 is dispensed from a roll 26 which is mounted on the carriage. The carriage can be any suitable apparatus for dispensing the support sheet for the support of insulation material. The support sheet is draped from the top portions 16 of adjacent parallel purlins and supports a layer of insulation material 28 that is placed on top of the support sheet between the adjacent purlins. Long sheets of hard roofing material 30 such as metal decking are then attached to the top portion of the purlins. Because the hard roofing material comes in long sheets and the roofs generally have two sloped sections, it is customary to construct the roof along the width of the sloped section and then proceed along the length of the structure from one end to the other. The workers stand on the previously attached hard roofing material to assemble the next section of roof. The carriage is moved by the workers as each section of roof is assembled. The carriage travels along the length of the purlins. Preferably, the carriage has rollers 31 riding on the top portion of the purlins for ease of movement. The carriage can be pushed by push rod 32 or can be propelled by any other suitable means, such as by a cable hooked to a winch or a motor.

The space between the vertical portions of adjacent purlins defines an insulation cavity 33. The insulation cavity has a generally rectangular cross-sectional shape having a width W extending between cavity sides 33*a*. It is advantageous to fill the insulation cavity with as much insulation material as possible. The greater the mount of insulation material occupying the insulation cavity, the higher the insulating qualities the roof structure will have. The purpose of the support sheet is to support the insulation material in the insulation cavity, but the support sheet can also be used as a vapor barrier and for aesthetic purposes. The support sheet can be of any suitable material for the stated purposes, such as vinyl or foil faced paper. The width of the support sheet is generally such that its edges slightly overhang the adjacent purlins. To accommodate this, a roller guide 34 is extended downward on top of the support sheet, causing the support sheet to have vertical portions 35 near the purlins and a horizontal portion 36. The vertical portions are located at the insulation cavity sides 33*a*. The forming of the vertical portions and the horizontal portion causes the support sheet to substantially conform to the shape of the generally rectangular cross-sectional insulation cavity.

The roller guide can be any suitable roller mechanism that rotates along the length of the dispensed support sheet and causes the support sheet to substantially conform to the shape of the insulation cavity. The rolling action of the roller guide prevents the roller guide from tearing or catching on the support sheet as the roller guide travels over the dispensing support sheet.

The roller guide, as shown in FIGS. 1 and 2, has two ends 37 which help spread the support sheet across the width of the insulation cavity. As shown in FIG. 2, wheels 38 are mounted on each end of the roller guide to spread the support sheet across the width of the insulation cavity to cause the support sheet to substantially conform to the shape of the insulation cavity. The wheels roll along the length of the support sheet as the support sheet is dispensed from the roll.

As shown in FIGS. 1 and 2, the support sheet roll 26 is mounted on the carriage by a mandrel 40. The support sheet roll can be supported by any suitable means which allows the support sheet to be dispensed from the roll. A roller 42 supports the sheet between the guides and the roll. The roller is positioned at a height just above the top portion 16 of the purlins. The roller helps spread out the support sheet prior to the guides' drawing the sides of the support sheet downward. The roller keeps the support sheet in tension in a direction normal to the length of the purlins as the guides push the support sheet downward. The support sheet is also in tension in a direction parallel to the length of the purlins, held by the assembled roof structure on one end and the roll 26 on the other end. Optionally, the roll can have a tension controller such as clutch 44 which is mounted on the mandrel to prevent the roll from unrolling when the carriage is stationary. When the support sheet is taut, the insulation material fills the insulation cavity and will not be compressed along the sides next to the purlins as the roof is assembled and the carriage moves down the purlins.

The insulation material can be dispensed from a roll 46 mounted on the carriage, and in a direction parallel to the length of the purlins. The insulation may also be laid across the purlins in a direction normal to their lengths. In this case, the workers unroll a long sheet of insulating material and place it across the purlins just in front of the completed roof. The hard roofing material is attached to the purlins over the insulation material and the carriage is moved along the purlins as needed. This insulation may be added on top of the insulation material between the purlins for additional thermal protection or as the only source of insulation material.

Although FIGS. 1 and 2 show a carriage extending between only two purlins the carriage can be any width up to the width of the roof itself. Multiple support sheet rolls can be mounted on a single carriage in an overlapping fashion so that multiple insulation cavities are insulated at one time. Likewise, multiple carriages can be used and moved in unison as the roof is constructed.

Figure 3:
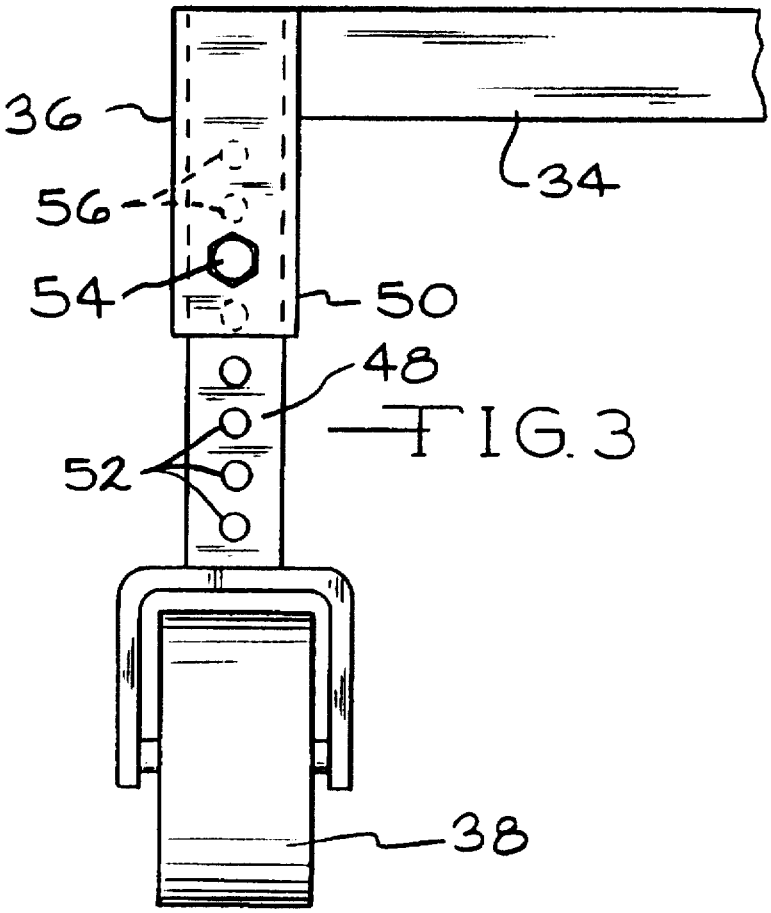
FIG. 3 is an elevational view of an adjustable roller guide.

FIG. 3 shows an adjustable version of the roller guide ends 37 to accommodate purlins having vertical portions of different heights. The wheel 38 is mounted on a shaft 48 that is inserted into a mounting tube 50 attached to the guide. A series of evenly spaced holes 52 are drilled in the shaft. The shaft is fastened to the tube by bolt 54 through a hole 56 in the tube. The height can be adjusted by removing the bolt and adjusting the shaft until a different hole 52 in the shaft lines up with the hole 56 in the tube and the bolt is re-inserted, fastening the shaft to the tube. The guide can be adjustable by any other suitable means such as a screw.

Figure 4:
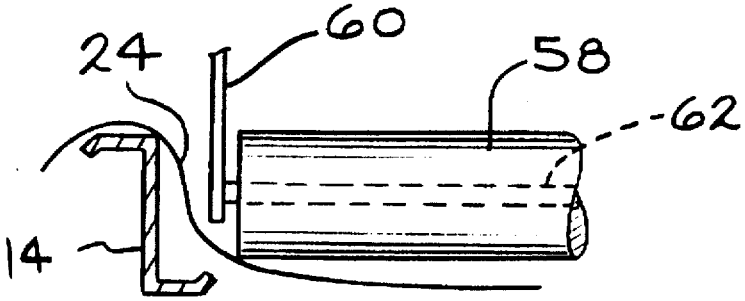
FIG. 4 is a partial elevational view of another embodiment of the guide comprised of a roller that spans a substantial portion of the width of the insulation cavity.

FIG. 4 illustrates a roller guide comprised of a single roller 58 that spans a substantial portion of the width W of the insulation cavity. The roller is mounted on the carriage by support member 60 and rotated about axle 62. The roller rotates along the length of the dispensing support sheet.

It is preferable to have the roller guide attached to the carriage so that the roller guide will not have to be moved separately with respect to the carriage. However, attachment is not necessary and the roller guide may be independent of the carriage's movement.

It will be evident from the foregoing that various modifications can be made to this invention. Such, however, are considered as being within the scope of the invention.

INDUSTRIAL APPLICABILITY

The invention can be useful in the construction of roof structures for metal buildings.

We claim:

1. Apparatus for providing a roof structure of the type having a plurality of purlins spaced apart from one another in a parallel arrangement, the purlins having a top portion and a generally vertical portion, the space between the vertical portions of adjacent purlins defining an insulation cavity that is generally rectangular in cross-sectional shape, the apparatus comprising;

a. a carriage movable in a first direction along the length of the purlins for paying out a support sheet for support of insulation material as the carriage travels along the length of the purlins so that the support sheet depends from the top portion of adjacent purlins; and b. a roller guide movable in the first direction and extending downward on top of the support sheet, rotating along the length of the support sheet, causing the support sheet to substantially conform to the shape of the insulation cavity.

2. The apparatus of claim 1 in which the roller guide is attached to the carriage.

3. The apparatus of claim 1 in which the roller guide is adapted to span a substantial portion of the width of the insulation cavity and is rotatable along the length of the dispensed support sheet.

4. The apparatus of claim 1 in which the roller guide has two ends adapted to be positioned at opposed sides of the insulation cavity, and in which the ends of the roller guide are comprised of wheels rotatable along the length of the dispensed support sheet.

5. The apparatus of claim 1 in which the roller guide is adjustable to accommodate purlins having vertical portions of different heights.

6. The apparatus of claim 1 in which the carriage is provided with a tension controller for maintaining the support sheet in tension in a direction along the length of the purlins.

7. The apparatus of claim 6 in which the tension controller comprises a clutch for maintaining the support sheet in tension in a direction along the length of the purlins.

8. In combination:

1) apparatus for providing a roof structure of the type having a plurality of purlins spaced apart from one another in a parallel arrangement, the purlins having a top portion and a generally vertical portion, the space between the vertical portions of adjacent purlins defining an insulation cavity that is generally rectangular in cross-sectional shape, the apparatus comprising:

a. a carriage movable in a first direction along the length of the purlins for paying out a support sheet for support of insulation material as the carriage travels along the length of the purlins so that the support sheet depends from the top portion of adjacent purlins; and b. a roller guide movable in the first direction and extending downward on top of the support sheet, rotating along the length of the support sheet, thereby causing the support sheet to substantially conform to the shape of the insulation cavity; and 2) a support sheet for support of insulation material where the support sheet is dispensed from the carriage, and where the support sheet is caused to substantially conform to the shape of the insulation cavity by the roller guide.

9. The combination of claim 8 further comprising insulation material placed on top of the support sheet, within the insulation cavity.

10. The combination of claim 9 in which insulation material is dispensable in the direction parallel to the purlin from a roll mounted on the carriage.

11. The combination of claim 9 in which the insulation material is adapted to substantially fill the insulation cavity.

12. The combination of claim 8 in which the carriage is provided with a tension controller to maintain the support sheet in tension in a direction along the length of the purlins.

13. The combination of claim 12 in which the support sheet is dispensed from a support sheet roll mounted on a mandrel positioned on the carriage, where the tension controller prevents the roll from unrolling while the carriage is stationary for maintaining the support sheet in tension in a direction along the length of the purlins.

14. The combination of claim 8 in which the roller guide is attached to the carriage.

15. In combination:

1) apparatus for providing a roof structure of the type having a plurality of purlins spaced apart from one another in a parallel arrangement, the purlins having a top portion and a generally vertical portion, the space between the vertical portions of adjacent purlins defining an insulation cavity that is generally rectangular in cross-sectional shape, the apparatus comprising;

a. a carriage movable in a first direction along the length of the purlins for paying out a support sheet for support of insulation material as the carriage travels along the length of the purlins so that the support sheet depends from the top portion of adjacent purlins, the carriage having a tension controller for maintaining the support sheet in tension in a direction along the length of the purlins; and b. a roller guide movable in the first direction and extending downward on top of the support sheet, rotating along the length of the support sheet, causing the support sheet to substantially conform to the shape of the insulation cavity;

2) a support sheet for support of insulation material where the support sheet is dispensed from the carriage, and where the support sheet is caused to substantially conform to the shape of the insulation cavity by the roller guide; and 3) insulation material placed on top of the support sheet.

16. The combination of claim 15 in which the support sheet is dispensed from a support sheet roll mounted on a mandrel positioned on the carriage, where the tension controller prevents the roll from unrolling while the carriage is stationary for maintaining the support sheet in tension in a direction along the length of the purlins.

17. The combination of claim 15 in which the roller guide has two ends adapted to be positioned at opposed sides of the insulation cavity, and in which the ends of the roller guide are comprised of wheels rotatable along the length of the dispensed support sheet.

18. The combination of claim 15 in which the roller guide is adapted to span a substantial portion of the width of the insulation cavity and is rotatable along the length of the dispensed support sheet.

19. The combination of claim 15 in which the roller guide is adjustable to accommodate purlins having vertical portions of different heights.

20. The combination of claim 15 in which the roller guide is attached to the carriage.

* * * * *